United States Patent [19]

Couper et al.

[11] Patent Number: 4,992,238

[45] Date of Patent: Feb. 12, 1991

[54] PROCESS FOR SHAPING AND IMPROVING THE MECHANICAL PROPERTIES OF BLANKS PRODUCED BY POWDER METALLURGY FROM AN ALLOY WITH INCREASED HIGH-TEMPERATURE STRENGTH BY EXTRUSION

[75] Inventors: Malcolm Couper, Station-Siggenthal; Reinhard Fried, Nussbaumen, both of Switzerland

[73] Assignee: Asea Brown Boveri Ltd., Baden, Switzerland

[21] Appl. No.: 386,239

[22] Filed: Jul. 28, 1989

[30] Foreign Application Priority Data

Aug. 2, 1988 [CH] Switzerland ..... 2895/88

[51] Int. Cl.[5] ..... B22F 1/00

[52] U.S. Cl. ..... 419/41; 419/19; 419/42; 419/48; 419/54

[58] Field of Search ..... 419/54, 41, 48, 19, 419/42

[56] References Cited

U.S. PATENT DOCUMENTS

| | | | |
|---|---|---|---|
| 1,144,595 | 6/1915 | Henderson | 148/4 |
| 3,084,042 | 4/1963 | Wartel et al. | 75/221 |
| 3,226,267 | 12/1965 | Foerster | 148/11.5 |
| 3,899,325 | 8/1975 | Harrison | 75/208 R |
| 3,922,182 | 11/1975 | Merrick | 148/32 |
| 4,050,143 | 9/1977 | Aslund | 29/420.5 |
| 4,143,208 | 3/1979 | Aslund | 428/558 |
| 4,605,599 | 8/1986 | Penrice et al. | 428/665 |
| 4,921,664 | 5/1990 | Couper | 419/1 |

*Primary Examiner*—Stephen J. Lechert, Jr.
*Assistant Examiner*—Leon Nigohosian
*Attorney, Agent, or Firm*—Oblon, Spivak, McClelland, Maier & Neustadt

[57] ABSTRACT

Process for shaping and improving the mechanical properties of blanks produced by powder metallurgy from an alloy with increased high-temperature strength by extrusion, and the deformation is successively performed in at least two temperature ranges different from one another or in two phases, in that the blank (2) is first reduced in its cross section at a temperature $T_1$ and then is either agin reduced in at a lower temperature $T_2$ or is deformed at a temperature $T_3$ under counterpressure so that its cross section is further widened. $T_3$ can be smaller than or equal to $T_1$.

15 Claims, 3 Drawing Sheets

PROCESS FOR SHAPING AND IMPROVING THE MECHANICAL PROPERTIES OF BLANKS PRODUCED BY POWDER METALLURGY FROM AN ALLOY WITH INCREASED HIGH-TEMPERATURE STRENGTH BY EXTRUSION

TECHNICAL FIELD

Further treatment of alloys produced by powder metallurgy with increased high-temperature strength. Reduction of the anisotropy of the properties of the workpieces caused by one-sided deformation.

The invention relates to a further development of shaping processes for achieving optimal structural configurations in high-temperature alloys produced from powders with precipitation hardening and/or dispersion hardening.

It relates especially to a process for shaping and improving the mechanical properties of blanks produced by powder metallurgy from an alloy with increased high-temperature strength by hot extrusion.

PRIOR ART

In the production of components from alloys produced by powder metallurgy the powder as a rule is precompressed cold or poured loose in a metal casing and then this blank in some way by use of pressure is further compressed and at the same time or afterwards is subjected to a shaping process. In this case, extrusion, especially hot extrusion, plays an important role in the entire production process. Then the workpiece is converted into the final shape by pressing, forging, mechanical working, etc.

Numerous extrusion techniques are known:

use of loose powder or cold precompressed compacts.

without or with casing (metal casing), in which case the latter acts partially as "lubricant" or is used only as a container for degassing by vacuum.

direct or indirect extrusion, in which case the latter is performed at reduced pressure.

usual pressing or pressing under hydrostatic pressure.

The following powders, among others, are pressed:

aluminum alloys, which contain a large number of intermetallic compounds in very fine distribution that remain from supersaturated melts by extremely fast cooling.

oxide-dispersion-hardened magnesium alloys.

dispersion-hardened copper alloys.

oxide-dispersion-hardened nickel-base superalloys.

A characteristic of extrusion consists in the fact that the semifinished product obtained has anisotropic properties. It exhibits different mechanical properties in different directions, which often makes the workpieces produced from it unusable.

The following documents were mentioned on the prior art:

J. Duszczyk and P. Jongenburger, "The Extrusion of Aluminum and its Alloys from Powders," in Reviews on Powder Metallurgy and Physical Ceramics, Vol. 2, No. 4, 1985, pp 269–311.

T. Sheppard, M. A. Zaidi, "Effect of preheat time-temperature cycles on development of microstructure and properties of extrusions prepared from Al-Fe-Mn rapidly solidified powders," Materials Science and Technology, Jan. 1986, Vol. 2, pp. 69–78.

Y. W. Kim, W. M. Griffith, F. H. Froes, "Surface oxides in P/M Aluminum Alloys," J. of Metals, Vol. 32, No. 8, 1985, pp. 17–33.

I. G. Palmer, M. P. Thomas, "Production and properties of thermally stable Al-Cr-Zr alloys," Metall. 41, June 1987, pp. 600–605.

Processing of the above-mentioned materials often leads to problems that are difficult to solve. Breaking up of the oxide skins surrounding the powder particles causes difficulties. But this breaking up is a condition for guaranteeing a good bonding between the individual grains. To achieve this, extremely high reduction conditions and high temperatures are usually necessary. This further leads to a deterioration of the mechanical properties, especially the deformability. The above-defined aluminum alloys produce moderate strengths (ultimate tensile strength about 400 MPa) and unsatisfactory ductility and toughness.

Especially the ductility and toughness in the plane crosswise to the extrusion direction are far under the values demanded for practical use. It was also determined that with cold hydrostatic extrusion only unsatisfactory ductility was achieved and good strengths were achieved only with limited dimensions and cross sections. The usual extrusion processes, moreover, are not easily suitable for the production of workpieces of certain desired dimensions. The cross-sectional dimensions and cross-sectional shape are often limited.

Therefore, there is a need for improving and further developing extrusion processes for high-temperature powders with a base of Al, Mg, Cu and Ni alloys.

SUMMARY OF THE INVENTION

The object of the invention is to indicate a process for shaping and improving the mechanical properties, especially the ductility of blanks produced by powder metallurgy from an alloy with increased high-temperature strength by extrusion, which is simple and economical and can be performed with a minimal input of machines and tools. The product is to exhibit as isotropic properties as possible and come as close as possible in its form to the end product. The process is to be especially suitable for mass production of components for thermal machines and the emphasis is on the use of high-temperature aluminum alloys.

This object is achieved in that in the initially mentioned process the deformation is successively performed in at least two temperature ranges different from one another, and the workpiece is first reduced in its cross section by hot extrusion in a higher temperature range and then is further deformed in a lower temperature range by hot extrusion, and its cross section is further reduced.

The object is further achieved in that the deformation is performed in at least two phases, and the workpiece is first reduced in its cross section by hot extrusion in a first temperature range and then is further deformed by hot extrusion in a second temperature range, and its cross section is again widened, so that immediately after the die it is forced to a comparatively angular deflection and to a flow crosswise to the extrusion direction.

BRIEF DESCRIPTION OF THE DRAWINGS

The invention is described by the following embodiments illustrated in more detail by the figures.

There are shown in.

DESCRIPTION OF THE PREFERRED EMBODIMENTS

Figure 1:
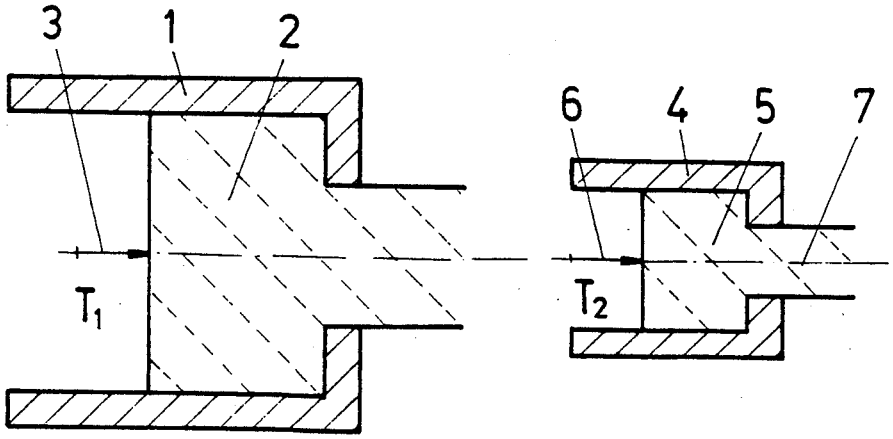
FIG. 1, diagrammatically the course of a 1st variant of the process with double cross-sectional reduction of the workpiece, FIG. 2, diagrammatically the course of a 2nd variant of the process with a cross-sectional reduction of the workpiece and a cross-sectional widening of the workpiece, FIG. 3, diagrammatically the course of a 2nd variant of the process with a cross-sectional reduction of the workpiece and a cross-sectional widening of the workpiece in one operation, FIG. 4, diagrammatically the course of a 3rd variant of the process with a double cross-sectional reduction of the workpiece and a cross-sectional widening of the workpiece, FIG. 5, a diagrammatic longitudinal section through an extrusion press for performing a 2nd variant of the process in the position immediately after beginning of the pressing, FIG. 6 a diagrammatic longitudinal section through an extrusion press for performing a 2nd variant of the process in the position in the 2nd half of the pressing operation, FIG. 7, a diagrammatic longitudinal section through an extrusion press for performing a 2nd variant of the process in the position at the end of the pressing operation.

FIG. 1 diagrammatically represents the course of a 1st variant of the process with double cross-sectional reduction of the workpiece. 1 is a first container of an extrusion press, in which a blank (compact) 2, produced by powder metallurgy, heated to temperature $T_1$, is located. 3 is the pressing force prevailing in this first container 1. 4 is the second container of an extrusion press, 5 is the already pressed workpiece at temperature $T_2$. 6 is the pressing force. 7 represents the finished workpiece which can be converted into the final shape by pressing, forging, mechanical working, etc., hereinafter referred to as the finished semifinished product. The condition that $T_2$ is less than $T_1$ prevails.

Figure 2:
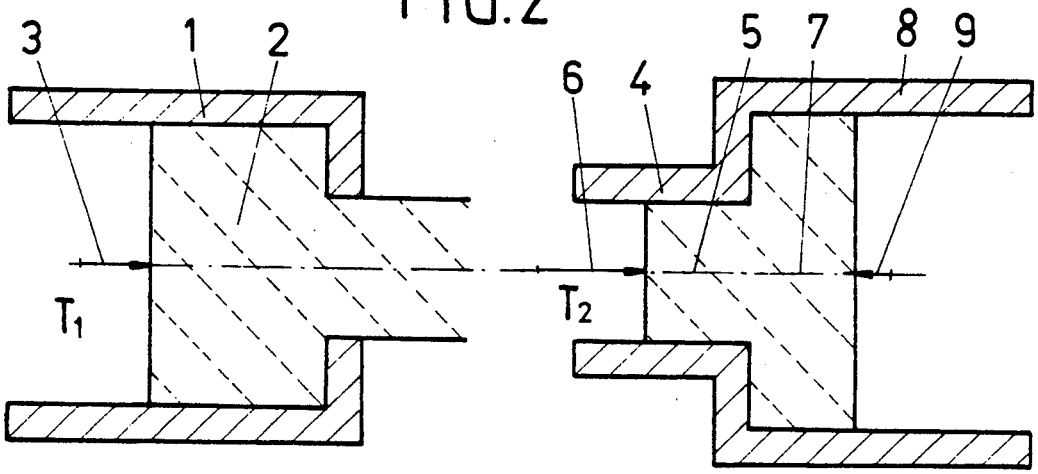

FIG. 2 relates to a diagrammatic course of a 2nd variant of the process with a cross-sectional reduction and a cross-sectional widening of the workpiece. The left side of FIG. 2 with container 1, blank 2 and pressing force 3 corresponds exactly to the left side of FIG. 1. 4 is the second container of an extrusion press for widening the cross section of workpiece (compact) 5. Extrusion takes place under pressing force 6 at temperature $T_2$, which can be equal to or less than $T_1$. 8 is a widened counterpressing cylinder, in which a pressing force 9 in the opposite direction is exerted on finished semifinished product 7.

Figure 3:
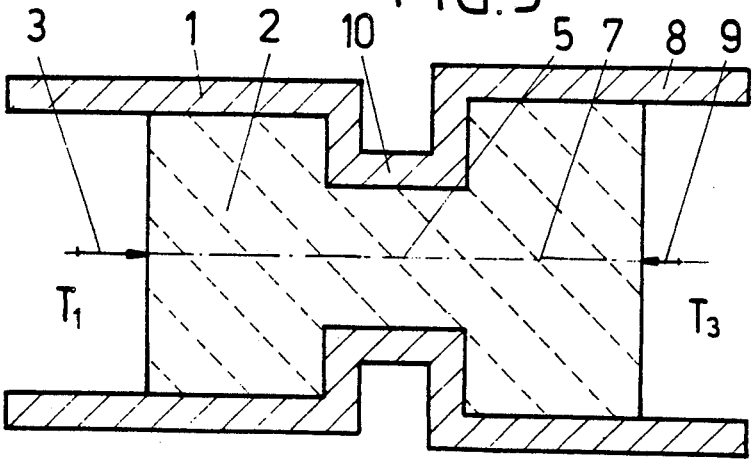

FIG. 3 represents the diagrammatic course of a 2nd variant of the process with a cross-sectional reduction and a cross-sectional widening of the workpiece in one operation. 10 is the cross-sectional narrowing in the shape of a die between container 1 and widened counterpressing cylinder 8. In the latter finished semifinished product 7 has temperature $T_3$, which can be the same or lower or higher than $T_1$.

All the remaining references correspond exactly to those of FIG. 2.

Figure 4:
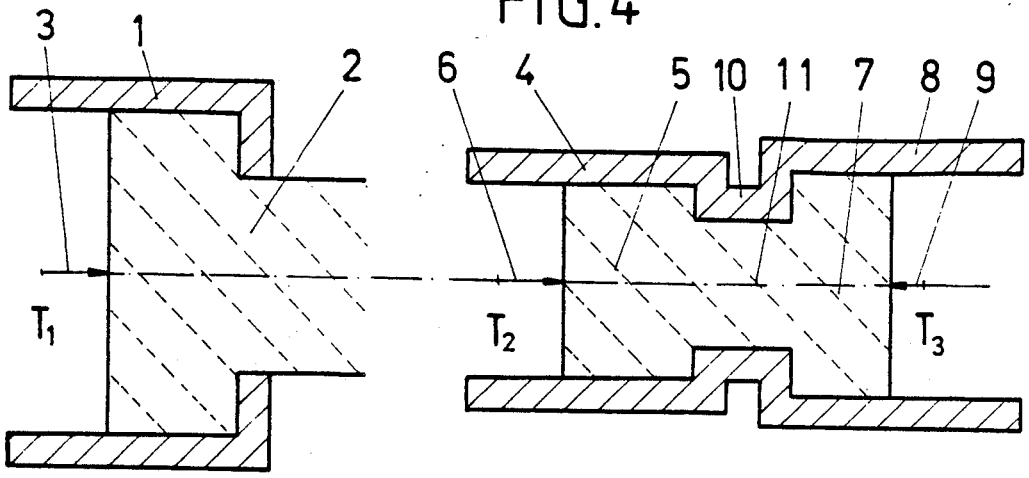

FIG. 4 shows the diagrammatic course of a 3rd variant of the process with double cross-sectional reduction and a cross-sectional widening of the workpiece. The left side of the figure corresponds exactly to that of FIG. 1, while the right side corresponds approximately to FIG. 3. A superposition of the first process step according to FIG. 1 and of a second and third process step according to FIG. 3 is involved. 11 means the twice extruded workpiece in the narrowing. All the other references correspond to those of the above-mentioned figures. Generally, $T_2$ is smaller than $T_1$, while $T_3$, at least within the framework of the material conditions, can be anything and even take the value of $T_1$.

Figure 5:
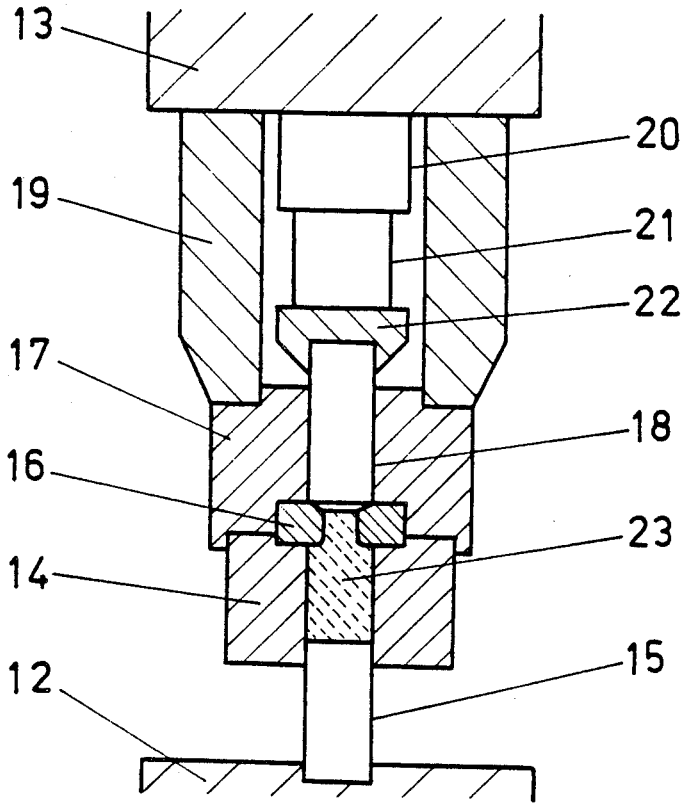

FIG. 5 represents a diagrammatic longitudinal section through an extrusion press for performing a 2nd variant of the process in the position immediately after the beginning of the pressing. The extrusion press is drawn with vertical main axis. But it can occupy any position in the space and, for example, can also be horizontal. 12 is a stationary table (base plate) of the press, 13 is a movable, hydraulically controlled table of the press. 14 is container I (pressing cylinder) in which the blank, pressing stock 23 to be deformed, is inserted. 15 is ram I, which fits into container I. 16 is an extrusion die made of high-temperature material. 17 is container II (counterpressing cylinder), in which ram II (counterram) is located, which is retracted as the pressing process advances. 19 is an intermediate piece between table 13 and container 17, which is used for force transmission. 20 is a hydraulically controlled counterpressure cylinder in which counterpressure piston 21 moves. The latter carries ram 18 by holder 22. In the present case, the diameters of ram I (15) and counterram II (18) are the same. Thus in the pressing operation an intensive through kneading of the material (pressing stock 23) but no lasting cross-sectional change takes place.

Figure 6:
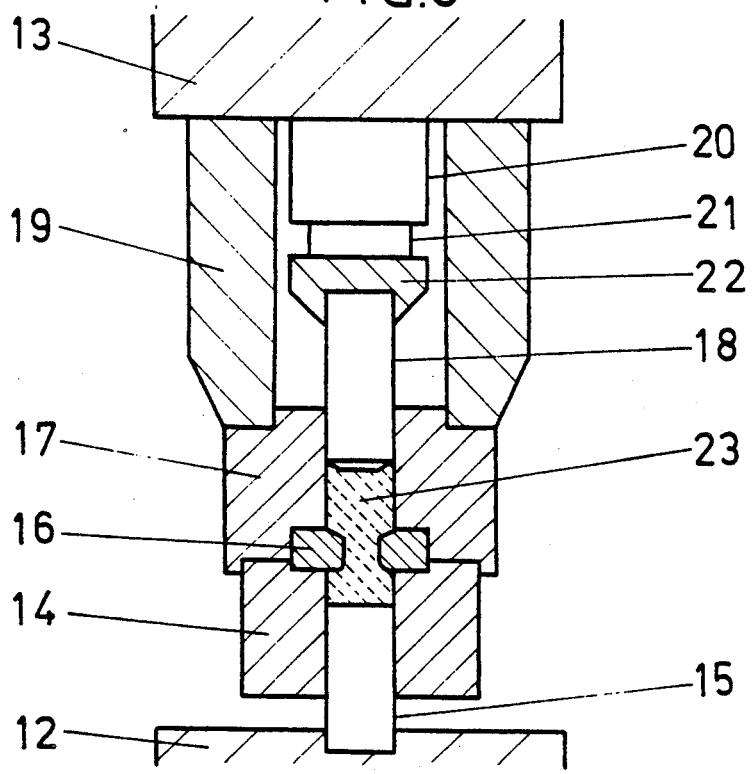

FIG. 6 represents a diagrammatic longitudinal section through an extrusion press for performing a 2nd variant of the process in the position in the 2nd half of the pressing operation. All references correspond to those of FIG. 5. Table 13 and, with it, containers II (17) and I (14) as well as extrusion die 16 move vertically downward, while ram II (18) to the same degree under the exertion of a counterpressure on pressing stock 23 is retracted upward.

Figure 7:
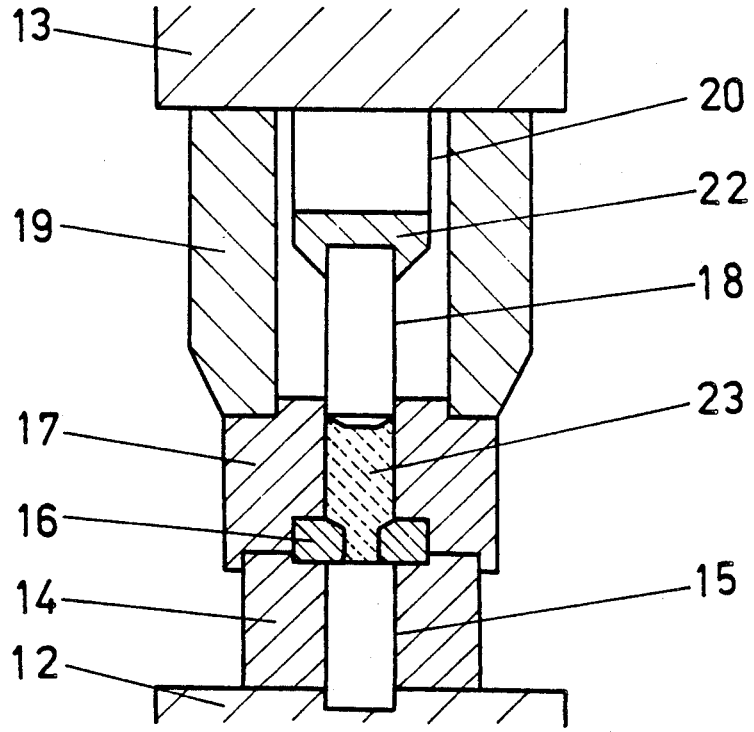

FIG. 7 represents a diagrammatic longitudinal section through an extrusion press for performing this 2nd variant of the process in a position at the end of the pressing operation. The pressing stroke is finished, container I (14) rests with its front face on table 12. Entire pressing stock 23 is in the hollow space, which is limited by the interior of die 16 and container II (17). The references correspond exactly to those of FIG. 5.

EMBODIMENT 1

See FIG. 1:

An alloy of the following composition was melted:

Fe=10% by weight

V=2% by weight

Al=rest.

The melt was cooled with a rate of at least $10^{6°}$ C/s by spraying with nitrogen and the powder produced in this way was processed by cold pressing into a cylindrical blank 200 mm in diameter. The blank was degassed in a vacuum and further compressed by hot pressing.

Then blank 2, as a compact, was put in a first container 1 of an extrusion press and was compressed at a temperature $T_1$ of 400° C. and a reduction ratio of 8:1 into a cylindrical rod with a diameter of 70 mm. The mechanical properties of the workpiece after this first process step, at room temperature were as follows:

| | Lengthwise | Crosswise | |
|---|---|---|---|
| Yield point | 395 | 375 | MPa |
| Tensile strength | 460 | 430 | MPa |
| Elongation (l = 5d) | 5 | 2 | % |
| Necking | 10 | 5 | % |

A piece was cut from the extruded rod (workpiece 5) 70 mm in diameter and further compressed in a second container 4 of an extrusion press at a temperature $T_2$ of 325° C with a reduction ratio of 3:1 to a rod 40 mm in diameter. The mechanical properties of the workpiece after this second process step at room temperature were as follows:

| | Lengthwise | Crosswise | |
|---|---|---|---|
| Yield point | 450 | 430 | MPa |
| Tensile strength | 485 | 470 | MPa |
| Elongation (l = 5d) | 10 | 8 | % |
| Necking | 30 | 20 | % |

The creep test showed a life up to fracture of more than 1000 hours under a tensile stress of 280 MPa at a temperature of 200° C

EMBODIMENT 2

See FIG. 1:

Analogously to example 1, an alloy was melted, a powder produced, compressed, degassed and extruded in two steps. The alloy had the following composition:

Fe=12% by weight
V=1% by weight
Zr=1% by weight
Al=rest.

Blank 2 has a diameter of 160 mm. The reduction ratio in the first step was 5:1, temperature $T_1$ was 430° C, the rod diameter was 70 mm. The strength values at room temperature were the following:

| | Lengthwise | Crosswise | |
|---|---|---|---|
| Yield point | 440 | 430 | MPa |
| Tensile strength | 530 | 520 | MPa |
| Elongation (l = 5d) | 6 | 1 | % |
| Necking | 10 | 1 | % |

A piece was cut from extruded workpiece 5 with a diameter of 70 mm and was upset under a forging press at a temperature of 350° C in the extrusion direction so that it assumed a diameter of 100 mm. Workpiece 5 was then put in a second container 4 of an extrusion press and compressed at a temperature of 280° C with a reduction ratio of 5:1 to a rod of 45 mm in diameter. The properties at room temperature were the following:

| | Lengthwise | Crosswise | |
|---|---|---|---|
| Yield point | 500 | 480 | MPa |
| Tensile strength | 550 | 530 | MPa |
| Elongation (l = 5d) | 12 | 6 | % |
| Necking | 30 | 15 | % |

The workpiece was then annealed for 2 hours at 400° C. No change of the mechanical properties, especially no deterioration of strength, could be determined.

The tensile test at 300° C showed a yield point of 270 MPa, which remained unchanged even after an annealing during 100 hours at 300° C.

EMBODIMENT 3

See FIG. 1:

A magnesium alloy was melted according to example 1 and a powder was produced from it. The alloy had the following composition:

Al=8% by weight
Zn=1% by weight
Mn=0.4% by weight
Mg=rest.

The powder was mechanically alloyed with 0.8% of $Al_2O_3$ in an attrition mill for 10 hours and in this way an oxide-dispersion-hardened alloy was produced. After cold pressing, degassing and hot repressing, blank 2 with a diameter of 150 mm was put in a first container of an extrusion press and was compressed at temperature $T_1$ of 450° C and a reduction ratio of 6:1 to a rod 60 mm in diameter. A section from the extruded rod was compressed in a second container 4 of an extrusion press at temperature $T_2$ of 360° C with a reduction ratio of 3:1 to a rod 35 mm in diameter. The properties at room temperature were as follows:

| | Lengthwise | Crosswise | |
|---|---|---|---|
| Yield point | 380 | 350 | MPa |
| Tensile strength | 430 | 390 | MPa |
| Elongation (l = 5d) | 8 | 6 | % |
| Necking | 15 | 12 | % |

EMBODIMENT 4:

See FIG. 1:

An oxide-dispersion-hardened copper alloy was produced similar to example 3. The matrix of the powder had the following composition:

Be=2% by weight
Co=0.5% by weight
Mn=1% by weight
Cr=0.2% by weight
Fe=0.3% by weight
Si=0.5% by weight
MgO=0.8% by weight
Cu=rest.

In the further processing of the powder mixture, it was processed exactly the same as under example 3. The extrusion press-reduction ratios and dimensions of the workpiece were the same. Temperature $T_1$ was 800° C, temperature $T_2$ was 650° C.

The following mechanical properties were measured at room temperature:

| | Lengthwise | Crosswise | |
|---|---|---|---|
| Yield point | 550 | 500 | MPa |
| Tensile strength | 1100 | 980 | MPa |
| Elongation (l = 5d) | 5 | 4 | % |
| Necking | 12 | 10 | % |

EMBODIMENT 5:

See FIG. 1:

As alloy an oxide-dispersion-hardened nickel-based superalloy with the tradename MA 6000 (Inco) with the following composition was selected:

Cr=15% by weight
W=4.0% by weight
Mo=2.0% by weight
Al=4.5% by weight
Ti=2.5% by weight
Ta=2.0% by weight
C=0.05% by weight
B=0.01% by weight
Zr=0.15% by weight
$Y_2O_3$=1.1% by weight
Ni=rest.

The alloy was present in precompressed, fine-grained state. A mechanically alloyed powder mixture was used as starting material.

A blank 2 with a diameter of 75 mm was put in a first container 1 of an extrusion press and compressed at a temperature $T_1$ of 1050° C and a reduction ratio of 6:1 into a rod with a diameter of 30 mm. A test rod, after recrystallization annealing at 1160° C, showed very moderate ductility values, especially in the crosswise direction. Lengthwise the elongation was about 5%, crosswise it was less than 1%.

A section from the rod (workpiece 5) 30 mm in diameter was further pressed in a second container 4 of an extrusion press at a temperature $T_2$ of 920° C with a reduction ratio of 4:1 into a rod with a diameter of 15 mm. The mechanical properties, after completed coarse grain annealing, showed a yield point of 980 MPa and an elongation of 8% in the extrusion direction and values of 580 MPa and 3% in the crosswise direction.

EMBODIMENT 6

See FIG. 2:

An aluminum alloy, exactly the same as under example 1, was melted and sprayed to a very fine powder. The powder was first compressed cold-isostatically under a pressure of 4000 bars into a green body, was welded in an aluminum casing, degassed under vacuum and repressed hot. In this case, the density was 77% of the theoretical value.

Blank 2 had a diameter of 30 mm. It was put in a first container 1 of an extrusion press and compressed at a temperature $T_1$ of 380° C with a reduction ratio of 4:1 into a rod 15 mm in diameter. The mechanical properties of the workpiece after this first process step were the following at room temperature:

| | Lengthwise | Crosswise | |
|---|---|---|---|
| Yield point | 380 | 350 | MPa |
| Tensile strength | 440 | 420 | MPa |
| Elongation (l = 5d) | 4 | 2 | % |
| Necking | 8 | 4 | % |

A section from the rod (workpiece 5) 15 mm in diameter was pressed in a second container 4 of an extrusion press at a temperature $T_2$ of 450° C with a widening ratio of 1:5.5 under a hydrostatic pressure of 4000 bars in counterpressing cylinder 8 (pressing force 9). Finished semifinished product 7 had a diameter of 35 mm. The mechanical properties of the workpiece, after this second process step, were the following at room temperature:

| | Lengthwise | Crosswise | |
|---|---|---|---|
| Yield point | 460 | 440 | MPa |
| Tensile strength | 490 | 475 | MPa |

-continued

| | Lengthwise | Crosswise | |
|---|---|---|---|
| Elongation (l = 5d) | 11 | 9 | % |
| Necking | 28 | 22 | % |

The creep test showed a life up to fracture of more than 2000 hours under a tensile stress of 260 MPa at a temperature of 210° C.

EMBODIMENT 7

See FIG. 4.

A magnesium alloy of the following composition was melted:

Al=6.5% by weight
Zn=2% by weight
Mn=0.2% by weight
Mg=rest.

The melt was sprayed to a fine-grain powder in an argon stream and the powder was then alloyed mechanically with 1% MgO in an attrition mill for 12 hours. In this way a high-temperature oxide-dispersion-hardened magnesium alloy was produced. The powder was cold-isostatically pressed under a pressure of 4500 bars, welded in a casing made of pure magnesium and degassed under vacuum. Blank 2 had a diameter of 60 mm.

Blank 2 as a compact was then put in first container 1 of an extrusion press and compressed at a temperature $T_1$ of 380° C with a reduction ratio of 4:1 into a cylindrical rod 30 mm in diameter.

A piece was cut from this rod (workpiece 5) and further processed in an extrusion press in a second container 4. The extrusion press had a cross-sectional narrowing (die) 10 and a widened counterpressing cylindrical 8. A temperature $T_2$ of 240° C prevailed in container 4, a temperature $T_3$ of 250° C prevailed in counterpressing cylinder 8 under a counterpressure 9, which corresponded to a hydrostatic pressure of 3000 bars. The reduction ratio was 3:1, so that workpiece 11 in narrowing 10 still exhibited a diameter of 17 mm. The widening ratio was 1:3. The finished semifinished product 7 thus had a diameter of 30 mm. The following mechanical properties were measured:

| | Lengthwise | Crosswise | |
|---|---|---|---|
| Yield point | 420 | 400 | MPa |
| Tensile strength | 470 | 450 | MPa |
| Elongation (l = 5d) | 10 | 8 | % |
| Necking | 18 | 14 | % |

EMBODIMENT 8

See FIG. 3:

An oxide-dispersion-hardened copper alloy was produced. The matrix had the following composition:

Be=1.5% by weight
Ni=0.5% by weight
Nm=1.5% by weight
Ti=0.5% by weight
Dispersoid: $Y_2O_3$=1.2% by weight
Cu=rest.

The dispersoid was mechanically alloyed in an attrition mill with the matrix in powder form. The powder mixture was cold-isostatically pressed, welded in a soft copper casing, evacuated and hot recompressed. Blank 2 had a diameter of 30 mm.

Blank 2 was then further processed in an extrusion press with a first container 1 and a widened counterpressing cylinder 8 as well as a cross-sectional narrowing 10. Temperature $T_1$ was 700° C, temperature $T_3$ was 650° C. The reduction ratio was 4.5:1, so that the rod in the narrowing still exhibited a diameter of 14 mm. The widening ratio was 1:5. Finished semifinished product 7 had a diameter of 32 mm. The mechanical strength values at room temperature were:

| | Lengthwise | Crosswise | |
|---|---|---|---|
| Yield point | 580 | 535 | MPa |
| Tensile strength | 1150 | 1030 | MPa |
| Elongation (l = 5d) | 4.5 | 4 | % |
| Necking | 10 | 9 | % |

EMBODIMENT 9

See FIG. 5 to 7:

A oxide-dispersion-hardened nickel-based superalloy with the tradename MA 6000 was selected as alloy: the composition can be seen from example 5. The starting material corresponded exactly to the data given under this example.

A blank with a diameter of 40 mm was put in a container I (14 in FIG. 5) of a double-action extrusion press and pressed by means of ram I (15) with a reduction ratio of 4:1 through extrusion die 16. The temperature in container I was 980° C. A counterpressure of 10,000 bars was built up in container II (17) as hydrostatically acting pressure by means of ram II (18). The two containers (14, 17) were reinforced by reinforcement rings located on the outside to be able to withstand the considerable pressures. Extrusion die 16 consisted of molybdenum alloy TZM, was reinforced by outside rings and had a bore with a diameter of 15 mm. Container II had a bore with a diameter of 30 mm, so that the widening ratio was 1:4. Temperature $T_3$ in container II was 1030° C. The mechanical values at room temperature were as follows (after zone annealing):

| | Lengthwise | Crosswise | |
|---|---|---|---|
| Yield | 960 | 540 | MPa |
| Tensile strength | 1050 | 620 | MPa |
| Elongation (l = 5d) | 6 | 3.5 | % |
| Necking | 8 | 5 | % |

The invention is not limited to the examples of the embodiment.

The process is performed in that the deformation is successively performed in at least two temperature ranges different from one another, and the material is first reduced in its cross section by hot extrusion in a higher temperature range $T_1$ and then is further deformed in a lower temperature range $T_2$ by hot extrusion, and its cross section is further reduced. The alloy with increased high-temperature strength is a precipitation-hardenable high-temperature aluminum alloy produced from supersaturated melt by extremely high cooling rate or an oxide-dispersion-hardened magnesium alloy or a precipitation-hardenable oxide-dispersion-hardened copper alloy or an oxide-dispersion-hardened nickel-based superalloy. In case of a high-temperature aluminum alloy the first deformation is performed in temperature range $T_1$ of 360° to 450° C with a first reduction ratio of 4:1 to 8:1 and the second deformation is performed in temperature range $T_2$ of 200° to 350° C with a second reduction ratio of 2:1 to 6:1, so that the total reduction ratio is 8:1 to 40:1. Blank 2 made of aluminum alloy produced by powder metallurgy is cold-isostatically prepressed and degassed or cold-isostatically prepressed, degassed and further cold or hot compressed. In a variant, the workpiece, between the two extrusion press process steps, is deformed by upsetting in the extrusion direction (hot forging) so that its cross section is widened.

The process is further performed in that the deformation is performed in at least two phases, and the workpiece is first reduced in its cross section by hot extrusion in a first temperature range $T_1$ and then is again deformed in a second temperature range $T_2$, $T_3$ by hot extrusion, and its cross section is again widened, so that immediately after die 10, 16 it is forced to a comparatively angular deflection and to a flow crosswise to the extrusion direction. In case of a high-temperature aluminum alloy the first deformation is performed in temperature range $T_1$ of 360° t 450° C with a reduction ratio of 4:1 and the second deformation serving to widen the cross section is performed in temperature range $T_2$, $T_3$ of 200° to 500° C with a widening ratio of 1:2 to 1:8.

The second deformation serving to widen the cross section can just about be an offset so that the product becomes 1 and in the end effect the workpiece exhibits the unchanged cross section of the blank. In a variant, a cross-sectional reduction by extrusion with a reduction ratio of 4:1 to 8:1 in temperature range $T_1$ of 360° to 450° C is placed upstream from the deformation consisting of cross-sectional reduction and cross-sectional widening.

Advantageously the second deformation is performed under hydrostatic pressure or under superposition of isostatic pressure in sense of a combined extrusion- and hot-isostatic pressing. Preferably, the first and second deformations are performed at the same time but locally separated in an extrusion press, which consists of two containers 14, 19, an intermediately placed extrusion die 16 and two rams 15, 18, and the latter perform an axial movement in the same direction relative to the center of extrusion die 16.

We claim:

1. Process for shaping and improving the mechanical properties of blanks (2) produced by powder metallurgy from an alloy with increased high-temperature strength by hot extrusion, characterized in that the deformation is successively performed in at least two temperature ranges different from one another, and the workpiece is first reduced in its cross section by hot extrusion in a higher temperature range ($T_1$) and then is further deformed in a lower temperature range ($T_2$) by hot extrusion, and its cross section is further reduced.

2. Process according to claim 1, wherein the alloy with increased high-temperature strength is selected from the group consisting of precipitation-hardenable high-temperature aluminum alloys produced from supersaturated melt by an extremely high cooling rate, oxide-dispersion-hardened magnesium alloys, precipitation-hardenable oxide-dispersion-hardened copper alloys and oxide-dispersion-hardened nickel-bas superalloys.

3. Process according to claim 2, wherein the alloy is a high-temperature aluminum alloy and the first deformation is performed in the temperature range ($T_1$) of 360° to 450° C with a first reduction ratio of 4:1 to 8:1 and the second deformation is performed in temperature range ($T_2$) of 200° to 350° C with a second reduction ratio of 2:1 to 6:1, so that the total reduction ratio is 8:1 to 40:1.

4. Process according to one of above claims 1 to 3, wherein blank (2) made of aluminum alloy produced by powder metallurgy is cold-isostatically prepressed and degassed or cold-isostatically prepressed, degassed and further cold or hot compressed.

5. Process according to claim 1, wherein the workpiece produced by the first deformation reducing the cross section is hot forged before the second deformation by upsetting in the extrusion direction so that its cross section is widened.

6. Process for shaping and improving the mechanical properties of blanks (2) produced by powder metallurgy from an alloy with increased high-temperature strength by hot extrusion, wherein the deformation is performed in at least two phases, and the material is first reduced in its cross section by hot extrusion in a first temperature range ($T_1$) and then is again deformed in a second temperature range ($T_2$, $T_3$) by hot extrusion, and its cross section is again widened, so that immediately after said first reduction it is forced to a comparatively angular deflection and to a flow crosswise to the extrusion direction.

7. Process according to claim 6, wherein the alloy with increased high-temperature strength is selected from the group consisting of precipitation-hardenable high-temperature aluminum alloys produced from supersaturated melt by an extremely high cooling rate, oxide-dispersion-hardened magnesium alloys, precipitation-hardenable oxide-dispersion-hardened copper alloys and oxide-dispersion-hardened nickel-based superalloys.

8. Process according to claim 7, wherein the alloy is a high-temperature aluminum alloy and wherein the first deformation is performed in temperature range ($T_1$) of 360° to 450° C with a reduction ratio of 4:1 and the second deformation serving to widen the cross section is performed in temperature range ($T_2$, $T_3$) of 200° to 500° C with a widening ratio of 1:2 to 1:8.

9. Process according to claim 8, wherein the second deformation serving to widen the cross section is performed at a temperature ($T_2$, $T_3$), which is below temperature ($T_1$) of the first deformation.

10. Process according to claim 8, wherein the second deformation serving to widen the cross section is performed at a temperature ($T_2$, $T_3$), which is above temperature ($T_1$) of the first deformation.

11. Process according to claim 8, wherein the cross-sectional reduction of the first deformation and the cross-sectional widening of the second deformation approximately offset each other so that the product has approximately the original cross-sectional area of the blank.

12. Process according to claim 11, wherein a cross-sectional reduction by extrusion with a reduction ratio of 4:1 to 8:1 in temperature range $T_1$ of 360° to 450° C is placed upstream from the deformation consisting of cross-sectional reduction and cross-sectional widening.

13. Process according to claim 6, wherein the second deformation is performed under hydrostatic pressure or under superposition of isostatic pressure in sense of a combined extrusion- and hot-isostatic pressing.

14. Process according to claim 6, wherein the first and second deformation are performed at the same time but locally separated in an extrusion press, which consists of two containers (14, 19), an intermediately placed extrusion die (16) and two rams (15, 18), and the latter perform an axial movement in the same direction relative to the center of extrusion die (16).

15. Process according to one of above claims 6 to 14, wherein blank (2) made of aluminum alloy produced by powder metallurgy is cold-isostatically prepressed and degassed or cold-isostatically prepressed, degassed and further cold or hot compressed.

* * * * *